US009340857B2

(12) United States Patent
Fukae et al.

(10) Patent No.: US 9,340,857 B2
(45) Date of Patent: May 17, 2016

(54) SINTERED ALLOY AND PRODUCTION METHOD THEREFOR

(71) Applicant: HITACHI POWDERED METALS CO., LTD., Matsudo-shi, Chiba (JP)

(72) Inventors: Daisuke Fukae, Matsudo (JP); Hideaki Kawata, Matsudo (JP)

(73) Assignee: HITACHI POWDERED METALS CO., LTD., Chiba (JP)

( * ) Notice: Subject to any disclaimer, the term of this patent is extended or adjusted under 35 U.S.C. 154(b) by 566 days.

(21) Appl. No.: 13/793,378

(22) Filed: Mar. 11, 2013

(65) Prior Publication Data

US 2013/0251585 A1 Sep. 26, 2013

(30) Foreign Application Priority Data

Mar. 26, 2012 (JP) ..... 2012-069771

(51) Int. Cl.

| | |
|---|---|
| ***C22C 38/02*** | (2006.01) |
| ***C22C 38/18*** | (2006.01) |
| ***C22C 38/22*** | (2006.01) |
| ***C22C 38/34*** | (2006.01) |
| ***C22C 38/36*** | (2006.01) |
| ***C22C 38/40*** | (2006.01) |
| ***C22C 38/44*** | (2006.01) |
| ***C22C 38/56*** | (2006.01) |
| ***C22C 33/02*** | (2006.01) |
| ***B22F 3/12*** | (2006.01) |
| ***C22C 30/00*** | (2006.01) |
| ***B22F 3/10*** | (2006.01) |
| ***C22C 38/00*** | (2006.01) |

(52) U.S. Cl.

CPC ..... *C22C 38/56* (2013.01); *B22F 3/1007* (2013.01); *C22C 30/00* (2013.01); *C22C 33/0214* (2013.01); *C22C 33/0285* (2013.01); *C22C 38/002* (2013.01); *C22C 38/02* (2013.01); *C22C 38/34* (2013.01); *C22C 38/40* (2013.01); *C22C 38/44* (2013.01); *B22F 3/12* (2013.01); *B22F 2999/00* (2013.01)

(58) Field of Classification Search

CPC C22C 33/0214; C22C 33/0285; C22C 38/02; C22C 38/08; C22C 28/12; C22C 38/18; C22C 38/22; C22C 38/24; C22C 38/26; C22C 38/34; C22C 38/36; C22C 38/40; C22C 38/44; C22C 38/46; C22C 38/48; C22C 38/56; B22F 3/1007; B22F 3/12; B22F 2201/01; B22F 2201/02

USPC ..... 419/11, 14; 75/236, 240; 420/11, 12, 420/43, 50, 51, 52, 53, 54, 55

See application file for complete search history.

(56) References Cited

U.S. PATENT DOCUMENTS

| | | | | |
|---|---|---|---|---|
| 4,243,414 | A * | 1/1981 | Takahashi | C22C 33/0285 419/11 |
| 4,345,943 | A * | 8/1982 | Takahashi | C22C 33/0285 75/236 |
| 6,123,748 | A * | 9/2000 | Whitaker | C22C 33/0285 419/37 |
| 6,852,143 | B2 * | 2/2005 | Hayashi | C22C 33/0214 75/240 |
| 7,892,481 | B2 | 2/2011 | Yoshihiro et al. | |
| 2002/0139448 | A1 | 10/2002 | Hayashi et al. | |
| 2004/0187830 | A1 | 9/2004 | Sato et al. | |
| 2007/0086910 | A1 * | 4/2007 | Liang | C22C 38/44 420/12 |
| 2009/0269235 | A1 * | 10/2009 | Fukae | B22F 3/12 419/11 |
| 2011/0146448 | A1 | 6/2011 | Fujitsuka et al. | |
| 2013/0058825 | A1 * | 3/2013 | Fukae | C22C 38/40 419/11 |

FOREIGN PATENT DOCUMENTS

| | | | |
|---|---|---|---|
| CN | 1517518 | A | 8/2004 |
| CN | 102102161 | A | 6/2011 |
| CN | 102172775 | A | 9/2011 |
| EP | 0946775 | * | 11/2000 |
| JP | A-60-255958 | | 12/1985 |
| JP | B2-3784003 | | 6/2006 |

OTHER PUBLICATIONS

Dec. 17, 2014 Office Action issued in Chinese Application No. 201310099125.X.

Sep. 7, 2015 Office Action issued in Chinese Patent Application No. 201310099125.

* cited by examiner

*Primary Examiner* — Helene Klemanski
(74) *Attorney, Agent, or Firm* — Oliff PLC

(57) ABSTRACT

A sintered alloy has an overall composition consisting of, by mass %, 13.05 to 29.62% of Cr, 6.09 to 23.70% of Ni, 0.44 to 2.96% of Si, 0.2 to 1.0% of P, 0.6 to 3.0% of C, and the balance of Fe and inevitable impurities; a metallic structure in which carbides are precipitated and uniformly dispersed in an iron alloy matrix having dispersed pores; and a density of 6.8 to 7.4 $Mg/m^3$. The carbides include specific carbides having maximum diameter of 1 to 10 μm and area ratio of 90% or more with respect to the total carbides.

6 Claims, No Drawings

SINTERED ALLOY AND PRODUCTION METHOD THEREFOR

BACKGROUND OF THE INVENTION

1. Technical Field

The present invention relates to a sintered alloy which may be preferably used for, for example, turbo components of turbochargers, specifically, nozzle bodies that must have heat resistance, corrosion resistance, and wear resistance, and relates to a production method therefor.

2. Background Art

In general, in a turbocharger installed for an internal combustion engine, a turbine is rotatably supported by a turbine housing connected to an exhaust manifold of the internal combustion engine, and plural nozzle vanes are rotatably supported such that the nozzle vanes surround the outer circumference of the turbine. Exhaust gas flowing in the turbine housing flows from the outer circumference of the turbine into the turbine and is discharged in the axial direction, thereby rotating the turbine. A compressor is provided at the same shaft as the shaft of the turbine and is at a side opposite to the side with the nozzle vanes. Then, the compressor is rotated, whereby air to be supplied to the internal combustion engine is compressed.

The nozzle vane is rotatably supported by a ring-shaped part called a "nozzle body" or a "nozzle mount". The shaft of the nozzle vane penetrates the nozzle body and is connected to a link structure. By driving the link structure, the nozzle vane is turned, and a degree to which a flow path is open is adjusted to allow exhaust gas to flow into the turbine. The present invention relates to turbo components that may be provided at a turbine housing, such as a nozzle body (nozzle mount) and a nozzle plate to be mounted on the nozzle body.

Since the above-described turbo components for turbochargers may be subjected to corrosive exhaust gas at high temperatures, the turbocharger must have heat resistance and corrosion resistance. In addition, since the turbo components slidingly contact a nozzle vane, the turbo components must also have wear resistance. Therefore, for example, a high Cr cast steel, a wear resistant material, and the like are conventionally used. The wear resistant material may be formed by performing a chromium surface treatment on a SCH22-type material, as specified by the JIS (Japanese Industrial Standards), in order to improve corrosion resistance. As a wear resistant component that has superior heat resistance, corrosion resistance, and wear resistance, and that is inexpensive, a heat resistant and wear resistant sintered component including carbides dispersed in a matrix of a ferrite stainless steel has been suggested (for example, see Japanese Patent No. 3784003).

Since the sintered component suggested in Japanese Patent No. 3784003 is obtained by liquid phase sintering, machining must be performed when the component is required to have high precision. However, the component is deteriorated in machinability since a large amount of hard carbides are precipitated therein. Therefore, improvement of machinability has been desired. The components of turbochargers are typically made from an austenitic heat resistant material. On the other hand, a turbo component for a turbocharger disclosed in Japanese Patent No. 3784003 is made from a ferritic material. In this case, the turbo component has a different thermal expansion coefficient from that of surrounding components, whereby a gap is readily formed between the components made from each material, and attachment of these components is insufficient. Therefore, the design of the turbo component is difficult for practical use, and the turbo component is required to have a similar thermal expansion coefficient as that of the surrounding austenitic heat-resistant material.

SUMMARY OF THE INVENTION

An object of the present invention is to provide a sintered alloy and production method therefor having superior heat resistance, corrosion resistance, wear resistance, and machinability, and a similar thermal expansion coefficient as that of an austenitic heat-resistant material, thereby allowing freedom of design.

In order to achieve the above object, the sintered alloy of the present invention is first specified as having a metallic structure in which fine carbides are precipitated and uniformly dispersed in an iron alloy matrix composed of a composition of an austenitic stainless steel. That is, since the alloy is an iron alloy having a matrix of a composition of an austenitic stainless steel, heat resistance and corrosion resistance at high temperature, and thermal expansion coefficient similar to general austenitic heat resistant materials are obtained. Furthermore, since fine carbides are uniformly dispersed in such an iron alloy matrix, rate of presence of the carbides in the matrix is increased. Therefore, a large number of carbides are intermediate in contact with a countercomponent, thereby improving wear resistance.

The carbides are precipitated from the iron alloy matrix, thereby uniformly dispersing. The precipitated carbides are mainly chromium carbides. Cr in an iron alloy matrix is necessary for obtaining heat resistance and corrosion resistance. Therefore, if Cr is excessively precipitated as carbide, heat resistance and corrosion resistance of the iron alloy matrix are reduced. In contrast, in the present invention, since chromium carbides are finely precipitated, decrease of amount of Cr in the iron alloy matrix surrounding the carbide is small. Therefore, since there is no portion in which amount of Cr is extremely low, decrease of heat resistance and corrosion resistance of the iron alloy matrix can be inhibited.

The sintered alloy of the present invention is second specified in having a density restricted to a specific range. Pores dispersed in a sintered alloy can easily be sites of crack initiation. If the number of pores is large, surface area of a sintered alloy increases and corrosion resistance is decreased. Therefore, it has been proposed to reduce the pores and reduce the influence of pores as in Japanese Patent No. 3784003. In contrast, in the present invention, a chromium passivation film formed on a surface of a sintered alloy is focused on, and a suitable number of pores remain by controlling the density of the sintered alloy in a specific range, thereby actively forming a chromium passivation film on the surface of the sintered alloy and the inner surface of the pores.

Chromium passivation film is hard and strongly fixed to the surface of the sintered alloy and the inner surface of the pores. In the sintered alloy of the present invention, a chromium passivation film is actively formed on the surface of the sintered alloy and the inner surface of the pores, thereby improving corrosion resistance and wear resistance.

The present invention provides a sintered alloy including: an overall composition consisting of, by mass %, 13.05 to 29.62% of Cr, 6.09 to 23.70% of Ni, 0.44 to 2.96% of Si, 0.2 to 1.0% of P, 0.6 to 3.0% of C, and the balance of Fe and inevitable impurities; a metallic structure in which carbides are precipitated and uniformly dispersed in an iron alloy matrix having dispersed pores; and a density of 6.8 to 7.4 $Mg/m^3$. The carbides include specific carbides having maximum diameter of 1 to 10 μm, the specific carbides have an area ratio of 90% or more with respect to that of all of the carbides. In the present invention, Fe alloy powder preferably further contains 2.96% or less of at least one of Mo, V, W, Nb, and Ti, and nitrides are preferably formed on the surface of the sintered alloy and inner surfaces of the pores.

The present invention provides a production method for a sintered alloy, the method including: preparing an Fe alloy powder, an Fe—P alloy powder, and a graphite powder, the Fe alloy powder consisting of, by mass %, 15 to 30% of Cr, 7 to 24% of Ni, 0.5 to 3.0% of Si, and the balance of Fe and inevitable impurities, the Fe—P alloy powder consisting of 10 to 30 mass % of P and the balance of Fe and inevitable impurities; mixing the Fe—P powder such that the amount of P is 0.2 to 1.0 mass %, 0.6 to 3.0 mass % of the graphite powder with the Fe alloy powder into a mixed powder; compacting the mixed powder into a green compact having a density of 6.0 to 6.8 $Mg/m^3$; and sintering the green compact at a temperature of 1100 to 1160° C. in a non-oxidizing gas at normal pressure.

The reasons for limiting the above amounts and functions of the present invention are described hereinafter. In the following descriptions, the symbol "%" represents "mass %".

Composition of Mixed Powder and Composition of Sintered Alloy

The iron alloy matrix of the sintered alloy of the present invention has a composition of an austenitic stainless steel. Austenitic stainless steel is an iron alloy in which Fe contains Cr and Ni in solid solution and is high in corrosion resistance and heat resistance, and has a thermal expansion coefficient approximately equivalent to that of typical austenitic heat-resistant steels. In order to obtain such an iron alloy matrix, an iron alloy powder in which Fe includes Cr and Ni in solid solution is used as a main raw material powder. Such elements are provided by alloying with iron or iron alloys, thereby uniformly dispersing in the matrix of the sintered alloy, and improving corrosion resistance and heat resistance.

The iron alloy matrix of the sintered alloy of the present invention shows superior corrosion resistance with respect to an oxidizing acid by containing 12% or more of Cr. Therefore, the amount of Cr contained in the iron alloy powder is 15% or more so as to maintain a sufficient amount of Cr in the iron alloy matrix of the sintered body even though a part of Cr contained in the iron alloy powder is precipitated as carbides in sintering. On the other hand, if the amount of Cr is more than 30%, a brittle σ phase is formed and compressibility of the iron alloy powder is extremely deteriorated. Therefore, the amount of Cr in the iron alloy powder as a raw material powder in the present invention is 15 to 30%.

In the iron alloy matrix, corrosion resistance with respect to a non-oxidizing acid is improved by containing 3.5% or more of Ni, and is improved without relation to the amount of Cr by containing 10% or more of Ni. On the other hand, even though the amount of Ni exceeds 24%, there is no expectation for further improvement of corrosion resistance, and Ni is an expensive element. Therefore, the upper limit of the amount of Ni in the iron alloy powder is 24%. Thus, the amount of Ni in the iron alloy powder in the present invention is 7 to 24%, and it is preferably 10 to 22%.

It should be noted that since atomic density of an austenitic structure is higher than that of a ferrite structure in crystallography, corrosion resistance in the austenitic structure is superior compared to that in the ferrite structure. Therefore, the amounts of Cr and Ni are preferably adjusted and contained in the iron alloy powder so that an austenitic structure is obtained after sintering. For example, in a metallic structure chart of an Fe—Cr—Ni type alloy after annealing, the horizontal axis is the amount of Cr and the vertical axis is the amount of Ni, and point A (Cr amount: 15%, Ni amount: 7.5%), point B (Cr amount: 18%, Ni amount: 6.5%), and point C (Cr amount: 24%, Ni amount: 18%) are set. In this case, an austenitic structure is obtained in the area in which the Ni amount is greater than that on the broken line connecting points A, B and C. Therefore, the amounts of Cr and Ni may be adjusted so that they are included in the area.

Since the iron alloy powder contains a large amount of oxidizable Cr, Si is added to a molten metal as a deoxidizing agent in production of the iron alloy powder. When Si is added in the iron alloy matrix in solid solution, oxidation resistance and heat resistance of the matrix are improved. If the amount of Si is less than 0.5%, the above effects are insufficient. If the amount of Si exceeds 3.0%, hardness of the iron alloy power is very high and compressibility of the powder is extremely deteriorated. Therefore, the amount of Si in the iron alloy powder is 0.5 to 3.0%.

Sintering for the iron alloy powder does not progress smoothly since the powder contains a large amount of Cr. Therefore, in the present invention, an Fe—P alloy powder is mixed with the iron alloy powder, thereby generating an Fe—P—C eutectic liquid phase in sintering and thereby promoting sintering. If the amount of P in the Fe—P alloy powder is less than 10%, the liquid phase is not sufficiently generated and densification of a sintered body is not facilitated. On the other hand, if the amount of P in the Fe—P alloy powder is greater than 30%, hardness of the Fe—P alloy powder is increased and compressibility of the powder is extremely deteriorated. If the amount of P in the overall composition is less than 0.2%, the liquid phase is not sufficiently generated and sintering is not sufficiently promoted. On the other hand, if the amount of P in the overall composition is greater than 1.0%, sintering is excessively promoted, whereby the compact is disadvantageously densified, and the density may exceed 7.4 $Mg/m^3$, which is the upper limit of the below-described sintered alloy. Furthermore, the Fe—P alloy readily leaks in a liquid phase, whereby the portion where the Fe—P alloy powder has existed remains as pores (Kirkendall voids). Therefore, since a large number of coarse pores are formed in the iron alloy matrix, corrosion resistance is reduced. Therefore, the amount of P in the Fe—P alloy powder is 10 to 30% and the balance is Fe, and amount of the Fe—P alloy powder in the mixed powder is set such that the amount of P in the overall composition of the mixed powder is 0.2 to 1.0%.

Such an iron alloy powder is mixed with a graphite powder and is sintered, whereby C is diffused in the iron alloy matrix and is bonded with Cr contained in the iron alloy matrix, thereby precipitating and dispersing chromium carbides. C added in the form of a graphite powder generates an Fe—P—C eutectic liquid phase together with the Fe—P alloy powder, thereby promoting sintering. If the amount of the graphite powder is less than 0.6%, the amount of precipitated carbides is insufficient and improvement of wear resistance is insufficient. Furthermore, since sintering is not sufficiently promoted, the density of the sintered body is not increased, and strength of the sintered body is reduced, thereby reducing wear resistance. On the other hand, if the amount of the graphite powder is greater than 3.0%, the amount of precipitated carbides is excessive, thereby promoting wear of a countercomponent, and the amount of Cr in the iron alloy matrix is reduced, thereby reducing heat resistance and corrosion resistance. Furthermore, a large amount of Fe—P—C eutectic liquid phase is generated, whereby sintering is excessively promoted, and the compact is disadvantageously densified and the density may exceed 7.4 $Mg/m^3$ which is the upper limit of the below described sintered alloy. Therefore, the amount of the graphite powder is 0.6 to 3.0%.

In the production method of the present invention, the Fe alloy powder preferably further contains 3% or less of at least one of Mo, V, W, Nb, and Ti. Mo, V, W, Nb, and Ti are carbide forming elements and are superior in carbide formation capacity compared to Cr, thereby preferentially forming carbides compared to Cr. Therefore, reducing amount of Cr in the iron alloy matrix is inhibited by containing the above elements, whereby heat resistance and corrosion resistance of the matrix can be improved. Furthermore, the above elements bond with C and form alloy carbides, thereby improving wear resistance.

When one or more of Mo, V, W, Nb, and Ti are added, if the total amount of these elements contained in solid solution in the iron alloy powder is more than 3.0%, the powder is hardened and compressibility is reduced. Furthermore, these optional elements are expensive, and excessive addition thereof causes higher production costs. Therefore, when one or more of Mo, V, W, Nb, and Ti are contained in the iron alloy powder, the total amount of these elements is 3% or less.

The sintered alloy of the present invention produced from a mixed powder obtained by mixing the Fe—P alloy powder and the graphite powder with the iron alloy powder is restricted in the composition of the powders and the addition amount of powders for the abovementioned reasons, whereby it includes the overall composition consisting of, by mass %, 13.05 to 29.62% of Cr, 6.09 to 23.70% of Ni, 0.44 to 2.96% of Si, 0.2 to 1.0% of P, 0.6 to 3.0% of C, and the balance of Fe and inevitable impurities. When one or more of Mo, V, W, Nb, and Ti is contained in the overall composition, the total amount of these elements is 2.96% or less.

Density of Compacted Body and Density of Sintered Alloy

In the sintered alloy of the present invention, the density of the sintered alloy is 6.8 to 7.4 $Mg/m^3$. The sintered alloy is produced by sintering a green compact obtained by compacting a mixed powder so that gaps between particles of the green compact remain as pores. When the number of pores is large, strength and wear resistance are reduced in inverse proportion to the number of pores. Therefore, in order to improve strength and wear resistance of a sintered alloy, the density of a sintered alloy may generally be increased and the number of pores reduced.

However, when the sintered alloy of the present invention is applied to components of turbochargers, a chromium passivation film is formed on the surface of the sintered alloy and the inner surface of pores by oxygen in an exhaust gas at high temperature, thereby improving wear resistance by the chromium passivation film. Therefore, the present invention needs specific numbers of pores.

That is, a chromium passivation film is hard and strongly affixed to the surface of the sintered alloy. Therefore, metallic adhesion of the iron alloy matrix to a countercomponent is inhibited by covering the surface of the sintered alloy with a chromium passivation film. Furthermore, suitable number of pores is dispersed in the sintered alloy, and the inner surfaces of the pores are covered by the chromium passivation film, whereby the pores function as stoppers which inhibit plastic flow of the iron alloy matrix, thereby improving wear resistance of the sintered alloy. Therefore, the upper limit of the density of the sintered alloy is 7.4 $Mg/m^3$. If the density of the sintered alloy exceeds 7.4 $Mg/m^3$, the number of pores decreases. As a result, stoppers for inhibiting plastic flow of the iron alloy matrix decrease and wear resistance is reduced. On the other hand, if the density of the sintered alloy is excessively low, strength of the sintered alloy is reduced and wear resistance is reduced. Therefore, lower limit of the density of the sintered alloy is 6.8 $Mg/m^3$.

In order to obtain a density of 6.8 to 7.4 $Mg/m^3$ in a sintered alloy after sintering a green compact formed from the above mixed powder at a temperature of the below-mentioned sintering temperature (1100 to 1160° C.), the density of the green compact must be 6.0 to 6.8 $Mg/m^3$. If the density of the green compact is less than 6.0 $Mg/m^3$, the density of the sintered body is less than 6.8 $Mg/m^3$. If the density of the green compact is more than 6.8 $Mg/m^3$, the density of the sintered body is more than 7.4 $Mg/m^3$.

Sintering Temperature

Sintering temperature in the present invention is 1100 to 1160° C. If the sintering temperature is less than 1100° C., sintering does not progress, and the strength and the wear resistance of the sintered body are reduced. Furthermore, since an Fe—P—C eutectic liquid phase is not sufficiently generated, it is difficult to obtain a density of 6.8 $Mg/m^3$ or more in the sintered alloy. On the other hand, if the sintering temperature is more than 1160° C., particles of carbides are coarse, and it may be difficult to obtain required amounts of carbides having required sizes. Furthermore, sintering excessively progresses and the density of the sintered alloy may exceed 7.4 $Mg/m^3$.

Atmosphere in Sintering

In producing a sintered alloy containing a large amount of chromium, a passivation film formed on a surface of a chromium-containing alloy powder as a raw material powder is removed for actively performing the sintering. Therefore, the sintering is performed in a vacuum or in a reduced-pressure atmosphere. On the other hand, the sintering in the present invention need not use an expensive vacuum or a reduced-pressure atmosphere since the density of 6.8 to 7.4 $Mg/m^3$ in the sintered alloy is sufficient and an Fe—P alloy powder is mixed and a liquid phase is generated in sintering, thereby promoting the sintering. That is, in the present invention, sintering can be performed in a non-oxidizing gas atmosphere at normal pressure, and these conditions are used for general sintered components, thereby performing sintering at low cost.

In the present invention, the sintering is preferably performed in a nitrogen gas or a mixed gas of nitrogen and hydrogen, which contains 10% or more of nitrogen, thereby forming nitrides on a surface of the sintered alloy and inner surfaces of pores. As a mixed gas of nitrogen and hydrogen, a mixed gas of nitrogen gas and hydrogen gas, an ammonia decomposition gas, a mixed gas in which an ammonia decomposition gas and a nitrogen gas are mixed, a mixed gas in which an ammonia decomposition gas and a hydrogen gas are mixed are exemplified. When sintering is performed in a gas atmosphere containing 10% or more of nitrogen, hard nitrides (mainly chromium nitrides) are formed on a surface of the sintered alloy and inner surfaces of pores, thereby improving wear resistance of the sintered alloy. It should be noted that the amount of N contained from the atmosphere into the sintered alloy is extremely small, which is the amount of inevitable impurities in the sintered alloy.

Size of Carbides

In the sintered alloy of the present invention, carbides are refined. That is, if coarse carbides are dispersed in a matrix, the dispersion is rough, and distance between adjacent carbides is great and area of portion in which carbide does not exist is large. Therefore, when the sintered alloy slides with a countercomponent, the portion in which carbide does not exist contacts a countercomponent, whereby the iron alloy matrix plastically flows and wear readily progresses.

On the other hand, if carbides are fine, the dispersion is dense, and distance between adjacent carbides is small and area of a portion in which carbide does not exist is small.

Therefore, when the sintered alloy slides with a countercomponent, the dense carbides contact the countercomponent and contact of the iron alloy matrix is decreased, and plastic flow of the iron alloy matrix is inhibited, thereby inhibiting progress of wear.

It should be noted that if the carbides are excessively fine, although the frequency of existence of the carbides is great, the carbide is readily embedded into the iron alloy matrix by contact with the countermaterial in sliding with the countermaterial. As a result, the iron alloy matrix contacts the countermaterial, and the iron alloy matrix readily plastically flows, thereby readily being worn.

From this point of view, the carbides include specific carbides having a maximum diameter of 1 to 10 μm, and an area ratio of the specific carbides is 90% or more with respect to that of all of the carbides. If the area ratio of the specific carbides having the maximum diameter of more than 10 μm exceeds 10% with respect to that of all of the carbides, the existing frequency of the carbides in the iron alloy matrix is small, and wear readily progresses in the portion in which carbide does not exist. If the area ratio of the carbides having a maximum diameter of less than 1 μm exceeds 10% with respect to that of all of the carbides, excessively fine carbides plastically flow together with the iron alloy matrix, thereby readily progressing wear.

According to the present invention, a sintered alloy having superior heat resistance, corrosion resistance, wear resistance, and machinability, and a similar thermal expansion coefficient as that of an austenitic heat-resistant material, thereby having easy designability can be provided.

PREFERRED EMBODIMENT OF THE INVENTION

(1) First Embodiment

The present invention will be explained in detail according to an embodiment. First, an Fe alloy powder consisting of, by mass %, 15 to 30% of Cr, 7 to 24% of Ni, 0.5 to 3.0% of Si, and the balance of Fe and inevitable impurities, an Fe—P alloy powder consisting of 10 to 30 mass % of P and the balance of Fe and inevitable impurities, and a graphite powder were prepared. The Fe alloy powder is mixed with the Fe—P alloy powder so that the amount of P is 0.2 to 1.0% with respect to the overall composition of the mixed powder, and is mixed with 0.6 to 3.0% of the graphite powder, thereby obtaining the mixed powder. The mixed powder is compacted to a predetermined form so that the density of the green compact is 6.0 to 6.8 $Mg/m^3$.

Then, the green compact is sintered at a temperature of 1100 to 1160° C. in a non-oxidizing gas atmosphere at normal pressure. By this process, a sintered alloy having an overall composition consisting of, by mass %, 13.05 to 29.62% of Cr, 6.09 to 23.70% of Ni, 0.44 to 2.96% of Si, 0.2 to 1.0% of P, 0.6 to 3.0% of C, and the balance of Fe and inevitable impurities.

The sintered alloy has a structure in which carbides are precipitated and uniformly dispersed in an iron alloy matrix having a composition of an austenitic stainless steel, the carbides include specific carbides having maximum diameter of 1 to 10 μm, and the area ratio of the specific carbides is 90% or more with respect to that of all of the carbides, and the density is 6.8 to 7.4 $Mg/m^3$. A chromium passivation film may be actively formed on the surface of the sintered alloy and inner surface of pores. Since the sintered alloy has a composition of an austenitic stainless steel, the alloy is superior in heat resistance and corrosion resistance at a high temperature. Furthermore, since the surface and the inner surfaces of the pores are covered by the chromium passivation film, which strongly bonds to the alloy, the corrosion resistance and the wear resistance are further improved. Moreover, since the precipitated and dispersed carbides are fine, machinability is superior. Since fine carbides are dispersed at high frequency in the iron alloy, a large number of carbides contact a countercomponent. Therefore, contact of the iron alloy matrix with the countercomponent is decreased, whereby the wear resistance is improved. In addition, a suitable number of pores are dispersed in the iron alloy matrix, and inner surfaces of the pores are covered by a chromium passivation film, whereby plastic flow of the iron alloy matrix is inhibited.

(2) Second Embodiment

3% or less of at least one of Mo, V, W, Nb, and Ti are added to the iron alloy powder of the first embodiment and a mixed powder is prepared in the same manner as in the first embodiment, and a sintered alloy is produced in a manner similar to the above. In this case, a sintered alloy in which 2.96% or less of at least one of Mo, V, W, Nb, and Ti are further contained in the composition of the sintered alloy in the first embodiment. Mo, V, W, Nb, and Ti which are carbide forming elements are superior in carbide formation capacity compared to Cr, thereby preferentially forming carbides compared to Cr. Therefore, reducing of amount of Cr in the iron alloy matrix is inhibited, whereby heat resistance and corrosion resistance of the matrix can be further improved. Since these optional elements bond to C and form carbides, the wear resistance can be further improved.

EXAMPLES

First Example

Alloy powders having compositions shown in Table 1 were prepared as iron alloy powders, and were added with 3% of an Fe—P alloy powder in which P amount was 20% and 1.5% of a graphite powder, thereby mixing and obtaining a mixed powder. The mixed powder was compacted and a columnar green compact having a density of 6.4 $Mg/m^3$, an outer diameter of 10 mm, and a height of 10 mm, and a disk-shaped green compact having a density of 6.4 $Mg/m^3$, an outer diameter of 24 mm, and a height of 8 mm were produced. Then, these green compacts were sintered at a temperature of 1130° C. in a non-oxidizing gas for 60 minutes, whereby sintered alloys of samples Nos. 01 to 21 were formed. All of the compositions of these sintered alloy samples are shown in Table 1.

The density of the sintered body of the disk-shaped sintered alloys of samples was measured by a sintered density measuring method based on JIS (Japanese Industrial Standard) Z2505.

Columnar sintered alloys of samples were cut, the cross sections were mirror polished and etched by an aqua regia (nitric acid/hydrochloric acid equal 1/3), and the metallic structure was observed by a microscope at a magnification of 200 times. The cross section was analyzed using an image analyzing apparatus (MITANI Corporation, WinRoof), and the diameter of carbides in a view was measured, whereby area ratio of carbides having the maximum diameter of 1 to 10 μm with respect to that of the entirety of the carbides was obtained.

Columnar sintered alloys of samples were heated at 900° C. in air for 100 hours, and the increased weight of the sample by the heating (oxidized amount in Table 1) was measured.

The disk-shaped sample was subjected to roll-on disk friction abrasion test with a roll. The roll was made from a stainless steel identical to JIS SUS316L and subjected to chromizing treatment, and had a diameter of 15 mm and a length of 22 mm. The test was performed such that the sample and the roll were contacted and reciprocally sliding at a temperature of 700° C. for 15 minutes. Wear amount of the disk was measured after the test.

Results of the above measurement are shown in Table 1. In the following explanation, the wear resistance of 10 μm or less and the increased weight by the heating of 15 g/m$^2$ were base of evaluation.

TABLE 1

| Sample | Mixing ratio mass % | | | | | | Whole composition mass % | | | | | |
|---|---|---|---|---|---|---|---|---|---|---|---|---|
| | Iron alloy powder | | | | Fe—P alloy | Graphite | | | | | | |
| No. | Fe | Cr | Ni | Si | powder | powder | Fe | Cr | Ni | Si | P | C |
| 01 | Bal. | 12.00 | 8.00 | 0.80 | 3.00 | 1.50 | Bal. | 11.46 | 7.64 | 0.76 | 0.60 | 1.50 |
| 02 | Bal. | 15.00 | 8.00 | 0.80 | 3.00 | 1.50 | Bal. | 14.33 | 7.64 | 0.76 | 0.60 | 1.50 |
| 03 | Bal. | 18.00 | 8.00 | 0.80 | 3.00 | 1.50 | Bal. | 17.19 | 7.64 | 0.76 | 0.60 | 1.50 |
| 04 | Bal. | 20.00 | 8.00 | 0.80 | 3.00 | 1.50 | Bal. | 19.10 | 7.64 | 0.76 | 0.60 | 1.50 |
| 05 | Bal. | 22.00 | 8.00 | 0.80 | 3.00 | 1.50 | Bal. | 21.01 | 7.64 | 0.76 | 0.60 | 1.50 |
| 06 | Bal. | 25.00 | 8.00 | 0.80 | 3.00 | 1.50 | Bal. | 23.88 | 7.64 | 0.76 | 0.60 | 1.50 |
| 07 | Bal. | 30.00 | 8.00 | 0.80 | 3.00 | 1.50 | Bal. | 28.65 | 7.64 | 0.76 | 0.60 | 1.50 |
| 08 | Bal. | 35.00 | 8.00 | 0.80 | 3.00 | 1.50 | Bal. | 33.43 | 7.64 | 0.76 | 0.60 | 1.50 |
| 09 | Bal. | 20.00 | 0.00 | 0.80 | 3.00 | 1.50 | Bal. | 19.10 | 0.00 | 0.76 | 0.60 | 1.50 |
| 10 | Bal. | 20.00 | 7.00 | 0.80 | 3.00 | 1.50 | Bal. | 19.10 | 6.69 | 0.76 | 0.60 | 1.50 |
| 04 | Bal. | 20.00 | 8.00 | 0.80 | 3.00 | 1.50 | Bal. | 19.10 | 7.64 | 0.76 | 0.60 | 1.50 |
| 11 | Bal. | 20.00 | 12.00 | 0.80 | 3.00 | 1.50 | Bal. | 19.10 | 11.46 | 0.76 | 0.60 | 1.50 |
| 12 | Bal. | 20.00 | 16.00 | 0.80 | 3.00 | 1.50 | Bal. | 19.10 | 15.28 | 0.76 | 0.60 | 1.50 |
| 13 | Bal. | 20.00 | 20.00 | 0.80 | 3.00 | 1.50 | Bal. | 19.10 | 19.10 | 0.76 | 0.60 | 1.50 |
| 14 | Bal. | 20.00 | 22.00 | 0.80 | 3.00 | 1.50 | Bal. | 19.10 | 21.01 | 0.76 | 0.60 | 1.50 |
| 15 | Bal. | 20.00 | 24.00 | 0.80 | 3.00 | 1.50 | Bal. | 19.10 | 22.92 | 0.76 | 0.60 | 1.50 |
| 16 | Bal. | 20.00 | 8.00 | 0.20 | 3.00 | 1.50 | Bal. | 19.10 | 7.64 | 0.19 | 0.60 | 1.50 |
| 17 | Bal. | 20.00 | 8.00 | 0.50 | 3.00 | 1.50 | Bal. | 19.10 | 7.64 | 0.48 | 0.60 | 1.50 |
| 04 | Bal. | 20.00 | 8.00 | 0.80 | 3.00 | 1.50 | Bal. | 19.10 | 7.64 | 0.76 | 0.60 | 1.50 |
| 18 | Bal. | 20.00 | 8.00 | 1.50 | 3.00 | 1.50 | Bal. | 19.10 | 7.64 | 1.43 | 0.60 | 1.50 |
| 19 | Bal. | 20.00 | 8.00 | 2.00 | 3.00 | 1.50 | Bal. | 19.10 | 7.64 | 1.91 | 0.60 | 1.50 |
| 20 | Bal. | 20.00 | 8.00 | 3.00 | 3.00 | 1.50 | Bal. | 19.10 | 7.64 | 2.87 | 0.60 | 1.50 |
| 21 | Bal. | 20.00 | 8.00 | 3.50 | 3.00 | 1.50 | Bal. | 19.10 | 7.64 | 3.34 | 0.60 | 1.50 |

| Sample No. | Density of sintered body Mg/m$^3$ | Area ratio of 1~10 μm carbides % | Wear amount μm | Oxidized amount g/m$^2$ | Notes |
|---|---|---|---|---|---|
| 01 | 7.30 | 97 | 6.0 | 30 | Exceeds lower limit of Cr |
| 02 | 7.26 | 97 | 4.0 | 14 | |
| 03 | 7.23 | 96 | 3.0 | 10 | |
| 04 | 7.20 | 95 | 2.4 | 8 | |
| 05 | 7.14 | 94 | 2.2 | 7 | |
| 06 | 7.04 | 93 | 2.0 | 6 | |
| 07 | 6.82 | 90 | 3.8 | 5 | |
| 08 | 6.61 | 85 | 11.0 | 16 | Exceeds upper limit of Cr |
| 09 | 7.12 | 95 | 2.0 | 16 | Exceeds lower limit of Ni |
| 10 | 7.19 | 95 | 2.4 | 10 | |
| 04 | 7.20 | 95 | 2.4 | 8 | |
| 11 | 7.25 | 95 | 2.4 | 7 | |
| 12 | 7.29 | 95 | 2.6 | 6 | |
| 13 | 7.31 | 95 | 2.6 | 6 | |
| 14 | 7.32 | 95 | 3.0 | 6 | |
| 15 | 7.34 | 95 | 3.0 | 6 | Upper limit of Ni |
| 16 | 7.25 | 95 | 3.0 | 16 | Exceeds lower limit of Si |
| 17 | 7.22 | 95 | 2.5 | 10 | |
| 04 | 7.20 | 95 | 2.4 | 8 | |
| 18 | 7.19 | 95 | 2.2 | 7 | |
| 19 | 7.16 | 95 | 2.5 | 6 | |
| 20 | 7.13 | 95 | 3.0 | 5 | |
| 21 | Could not compact | — | — | — | Exceeds upper limit of Si |

Effects of Amount of Cr

Effects of the amount of Cr in the sintered alloy were evaluated based on the sintered alloys of samples Nos. 01 to 08 in Table 1.

The density of the sintered compact showed a tendency to slightly decrease according to increase of the amount of Cr. The reason for this tendency may be that the amount of chromium passivation film on the surface of the iron alloy powder increased according to increase of the amount of Cr, whereby densification of the sintered body was difficult in the sintering. Therefore, in sample No. 08 in which Cr amount exceeded 30% in the iron alloy powder, the density of the sintered body was much less than 6.8 Mg/m$^3$.

Since Cr is a ferrite stabilizing element, the C amount in solid solution in the sintered alloy matrix was reduced, the amount of precipitated chromium carbides was increased, and chromium carbides grew according to increase of the Cr amount. Therefore, the area ratio of carbides having the maximum diameter of 1 to 10 μm showed a tendency to decrease.

Thus, in sample No. 08 in which Cr amount exceeded 30%, the area ratio of carbides having the maximum diameter of 1 to 10 μm was less than 90%.

The C amount in solid solution in the sintered alloy matrix was reduced and the amount of precipitated chromium carbides was increased as the amount of Cr, which is a ferrite stabilizing element, was increased. Therefore, wear resistance was improved and the wear amount was reduced up to 25% of the Cr amount in the iron alloy powder (samples Nos. 01 to 06). When the Cr amount in the iron alloy powder was greater than 25% (samples No. 07 and 08), the precipitated chromium carbides were coarse and the strength of the sintered body was reduced due to reducing of density, whereby the wear amount of the sintered body showed a tendency to increase. Thus, when the Cr amount in the iron alloy powder was more than 30%, the wear amount was extremely increased.

In the sintered alloy of sample No. 01 in which Cr amount in the iron alloy powder was less than 15%, the amount of Cr in the iron alloy matrix was small and the oxidized amount was extremely large. On the other hand, in the sintered alloy of sample No. 02 in which Cr amount in the iron alloy powder was 15%, the corrosion resistance was improved since a sufficient amount of Cr was contained in the iron alloy matrix, whereby the oxidized amount was reduced to 14 g/m$^2$. Furthermore, the corrosion resistance was further improved according to increase of the Cr amount, whereby the oxidized amount showed a tendency to decrease. However, in sample No. 08 in which the Cr amount was more than 30%, the oxidized amount was more than 15 g/m$^2$ even though the Cr amount was increased. The reason for this result is that although formation of an oxide layer on an outermost surface was inhibited, oxidization progressed to the inner portion of the sintered body via pores since sintering was not sufficiently progressed. Furthermore, since sample No. 08 contained a large amount of Cr which is a ferrite stabilizing element, the sintered body was magnetic and hardly included an austenitic structure, thereby being not suitable for the present invention.

Thus, it was confirmed that the Cr amount in the iron alloy powder must be 15 to 30%, the density of the sintered body must be 6.8 Mg/m$^3$ or more, and the area ratio of carbides having the maximum diameter of 1 to 10 μm must be 90% or more.

Effects of Amount of Ni

Effects of the amount of Ni in the sintered alloy were evaluated based on the sintered alloys of samples Nos. 04, 09 to 15 in Table 1.

The density of the sintered body showed a tendency to gradually increase according to increase of the Ni amount. The reason for this tendency is that the amount of Ni having a higher specific gravity than Fe was increased, and the density ratio was approximately constant (94%). That is, the true density of the sample is increases as the Ni amount increases. When the green compact is formed at a constant compact density of 6.4 Mg/m$^3$, the density ratio is decreased as the Ni amount was increased. However, since an Fe—P—C eutectic liquid phase is generated in the sintering, the density ratio of the sintered body is constant within the range of the Ni amount.

Since Ni promotes austenitizing of the iron alloy matrix, the amount of carbides precipitated in the iron alloy matrix is decreased as the Ni amount is increased. It should be noted that even though the amount of carbides was decreased, the area ratio of carbides having the maximum diameter of 1 to 10 μm was constant in each sample. Since the amount of the carbides decreased, the wear amount showed a tendency to slightly increase. Since sufficient amount of carbides was precipitated in the iron alloy matrix within the range of the Ni amount in the iron alloy powder up to 24%, the wear amount was of no matter.

In sample No. 09 which did not contain Ni, the oxidized amount was 16 g/m$^2$. In contrast, in sample No. 10 in which Ni amount was 7%, the oxidized amount was reduced to 10 g/m$^2$ since the corrosion resistance of the iron alloy matrix was improved. It was shown a tendency to improve the corrosion resistance of the iron alloy matrix and to reduce the oxidized amount as the Ni amount was increased.

Thus, it was confirmed that corrosion resistance was improved when the Ni amount in the iron alloy powder was 7% or more. Also it was confirmed that the wear resistance and the corrosion resistance were improved when the Ni amount in the iron alloy powder was up to 24%. It should be noted that if the Ni amount is further increased, the oxidized amount may increase since the amount of carbides is decreased, and material cost increases since Ni is expensive. Therefore, the Ni amount is 24% or less.

Effects of Amount of Si

Effects of the amount of Si in the sintered alloy are evaluated based on the sintered alloys of samples Nos. 04, 16 to 21 in Table 1.

The density of the sintered body showed a tendency to gradually decrease as the Si amount was increased. The reason for this tendency is that the amount of Si having lower specific gravity than Fe was increased, and the density ratio was approximately constant (94%). That is, the true density of the sample decreased as the Si amount increased. When a green compact is formed at constant compact density of 6.4 Mg/m$^3$, the density ratio increased as the Si amount was increased. However, since an Fe—P—C eutectic liquid phase was generated in the sintering, the density ratio of the sintered body was constant within the range of the Si amount. However, since Si hardens and causes embrittlement of the iron alloy matrix, the iron alloy powder was hardened and embrittled as the amount of Si increased. Therefore, compacting at high pressure is difficult if the Si content is large. In sample No. 21 in which the Si content in the iron alloy powder was more than 3%, compacting was difficult and a green compact was not obtained.

Si does not affect formation of carbides. Therefore, in samples Nos. 04, and 16 to 20, the area ratio of carbides having the maximum diameter of 1 to 10 μm was constant regardless of the Si amount. Furthermore, since Si forms oxides and increases the wear resistance of the iron alloy matrix, the wear amount showed a tendency to slightly decrease. However, when the Si amount was increased, the Si oxides on the surface of the iron alloy powder prevented progress of sintering and reduced the strength of the sintered body. Therefore, when the Si amount in the iron alloy powder was greater than 1.5%, the wear amount showed a tendency to slightly increase.

In sample No. 16, in which the Si amount was 0.2% in the iron alloy powder, the oxidized amount was 16 g/m$^2$. In contrast, in sample No. 17, in which the Si amount was 0.5% in the iron alloy powder, the corrosion resistance of the iron alloy matrix was improved and the oxidized amount was reduced to 10 g/m$^2$. The corrosion resistance of the iron alloy matrix was further improved as the Si amount was increased, the oxidized amount showed a tendency to decrease.

Thus, it was confirmed that the corrosion resistance was improved when the Si amount in the iron alloy powder was 0.5% or more. It was also confirmed that a green compact could be compacted when the Si amount was up to 3%, but could not be compacted when the Si amount was greater than 3%. Therefore, the Si amount must be 0.5 to 3%.

Second Example

An iron alloy powder (Fe-20% Cr-8% Ni-0.8% Si) which was used for the sintered alloy of sample No. 04 in the first example was added with an Fe—P alloy powder, in which the composition and amount are shown in Table 2, and 1.5% of a graphite powder, thereby mixing and obtaining a mixed powder. The mixed powder was compacted and the green compacts were sintered in the same condition as in the first example, whereby sintered alloy samples Nos. 22 to 33 were formed. All of the compositions of the sintered alloy samples are shown together in Table 2. The sintered alloy samples were subjected to the same tests as in the first example. The results of the tests are shown in Table 2 together. The results in sample No. 04 in the first example are shown in Table 2 together.

TABLE 2

| Sample No. | Mixing ratio mass % Iron alloy powder | Fe—P alloy powder | Composition % Fe | Composition % P | Graphite powder | Whole composition mass % Fe | Cr | Ni | Si | P | C |
|---|---|---|---|---|---|---|---|---|---|---|---|
| 22 | Bal. | 0.50 | Bal. | 20.00 | 1.50 | Bal. | 19.60 | 7.84 | 0.78 | 0.10 | 1.50 |
| 23 | Bal. | 1.00 | Bal. | 20.00 | 1.50 | Bal. | 19.50 | 7.80 | 0.78 | 0.20 | 1.50 |
| 24 | Bal. | 2.00 | Bal. | 20.00 | 1.50 | Bal. | 19.30 | 7.72 | 0.77 | 0.40 | 1.50 |
| 04 | Bal. | 3.00 | Bal. | 20.00 | 1.50 | Bal. | 19.10 | 7.64 | 0.76 | 0.60 | 1.50 |
| 25 | Bal. | 4.00 | Bal. | 20.00 | 1.50 | Bal. | 18.90 | 7.56 | 0.76 | 0.80 | 1.50 |
| 26 | Bal. | 5.00 | Bal. | 20.00 | 1.50 | Bal. | 18.70 | 7.48 | 0.75 | 1.00 | 1.50 |
| 27 | Bal. | 6.00 | Bal. | 20.00 | 1.50 | Bal. | 18.50 | 7.40 | 0.74 | 1.20 | 1.50 |
| 28 | Bal. | 3.00 | Bal. | 5.00 | 1.50 | Bal. | 19.10 | 7.64 | 0.76 | 0.15 | 1.50 |
| 29 | Bal. | 3.00 | Bal. | 10.00 | 1.50 | Bal. | 19.10 | 7.64 | 0.76 | 0.30 | 1.50 |
| 30 | Bal. | 3.00 | Bal. | 15.00 | 1.50 | Bal. | 19.10 | 7.64 | 0.76 | 0.45 | 1.50 |
| 04 | Bal. | 3.00 | Bal. | 20.00 | 1.50 | Bal. | 19.10 | 7.64 | 0.76 | 0.60 | 1.50 |
| 31 | Bal. | 3.00 | Bal. | 25.00 | 1.50 | Bal. | 19.10 | 7.64 | 0.76 | 0.75 | 1.50 |
| 32 | Bal. | 3.00 | Bal. | 30.00 | 1.50 | Bal. | 19.10 | 7.64 | 0.76 | 0.90 | 1.50 |
| 33 | Bal. | 3.00 | Bal. | 35.00 | 1.50 | Bal. | 19.10 | 7.64 | 0.76 | 1.05 | 1.50 |

| Sample No. | Density of sintered body $Mg/m^3$ | Area ratio of 1~10 μm carbides % | Wear amount μm | Oxidized amount $g/m^2$ | Notes |
|---|---|---|---|---|---|
| 22 | 6.51 | 99 | 10.0 | 18 | Exceeds lower limit of P |
| 23 | 6.90 | 98 | 4.2 | 14 | |
| 24 | 7.09 | 96 | 3.0 | 10 | |
| 04 | 7.20 | 95 | 2.4 | 8 | |
| 25 | 7.31 | 92 | 3.1 | 8 | |
| 26 | 7.40 | 90 | 9.2 | 10 | |
| 27 | 7.52 | 87 | 15.3 | 16 | Exceeds upper limit of P |
| 28 | 6.69 | 99 | 7.0 | 24 | Exceeds lower limit of P |
| 29 | 6.85 | 98 | 3.1 | 12 | |
| 30 | 7.01 | 96 | 2.6 | 10 | |
| 04 | 7.20 | 95 | 2.4 | 8 | |
| 31 | 7.30 | 92 | 3.3 | 8 | |
| 32 | 7.39 | 90 | 7.3 | 9 | |
| 33 | 7.45 | 80 | 12.0 | 15 | Exceeds upper limit of P |

Effects of Amount P

Effects of the amount of the Fe—P alloy powder were evaluated based on the sintered alloy samples Nos. 04, and 22 to 27, in Table 2.

In the sintered alloy of sample No. 22 in which the amount of the Fe—P alloy powder was small and the P amount in the overall composition was less than 0.2%, generation of an Fe—P—C eutectic liquid phase was small and the sintering was not promoted, whereby the density of the sintered body was extremely low. In contrast, in the sintered alloy of sample No. 23 in which the amount of the Fe—P alloy powder was increased and the P amount in the overall composition was 0.2%, generation of an Fe—P—C eutectic liquid phase was sufficient, whereby the density of the sintered body was increased to 6.90 $Mg/m^3$. When the amount of the Fe—P alloy powder was further increased and the P amount in the overall composition was increased (samples Nos. 04 and 24 to 27), generation of an Fe—P—C eutectic liquid phase was increased according to increase of the P amount, whereby density of the sintered body showed a tendency to increase. Thus, in sample No. 27 in which the P amount in the overall composition was more than 1%, the density of the sintered body was more than 7.4 $Mg/m^3$.

When generation of an Fe—P—C eutectic liquid phase was increased and the sintering was promoted, growth of chromium carbides was promoted and coarse chromium carbides were formed. Therefore, the area ratio of carbides having the maximum diameter of 1 to 10 μm was decreased as the amount of Fe—P alloy powder was increased and the P amount in the overall composition was increased. As a result, in the sintered alloy of sample No. 27 in which the P amount was more than 1%, the area ratio of carbides having the maximum diameter of 1 to 10 μm was reduced to less than 90%.

The density of the sintered body was increased according to increase of the P amount in the overall composition. Therefore, in the sintered bodies of samples Nos. 04 and 22 to 24 in which the P amount in the overall composition was up to 0.6%, the wear amount showed a tendency to decrease according to increase of the P amount. In contrast, in the sintered bodies of samples Nos. 25 to 27 in which the P amount in the overall composition was more than 0.6%, disadvantageous effects of decrease of the number of pores and formation of coarse carbides were significant rather than the effect of improving the strength of the sintered alloy. If the number of pores is decreased, the amount of passivation film formed on the inner surface of pores is decreased, and amount of stoppers for inhibiting plastic flow of the iron alloy matrix is decreased. If coarse carbides are formed, distances between adjacent carbides are large and the effect of inhibiting plastic flow of the iron alloy matrix is reduced. Therefore, the wear amount showed a tendency to increase according to increase in the P amount. As a result, in the sintered alloy of sample 27 in which the P amount in the overall composition was more than 1%, the wear amount was large and more than 10 μm.

In the sintered alloys of samples Nos. 04 and 22 to 25 in which the P amount in the overall composition was up to 0.8%, the density of the sintered body was increased according to increase of the P amount, whereby the surface area of the sintered alloy was decreased and the oxidized amount showed a tendency to decrease. In contrast, in the sintered alloys of samples Nos. 26 and 27 in which the P amount in the overall composition was more than 0.8%, an Fe—P—C eutectic liquid phase was generated and leaked. As a result, the number of pores (Kirkendall voids) was increased and the oxidized amount showed a tendency to increase. Therefore, in the sintered alloy of sample 27 in which the amount of the Fe—P alloy powder was excessive, the oxidized amount was extremely increased.

Thus, it was confirmed that when the P amount in the overall composition was 0.2 to 1%, the wear resistance and the corrosion resistance were improved.

Effects of the amount of P in the Fe—P alloy powder were evaluated based on the sintered alloys of samples Nos. 04, 28 to 33 in Table 2.

In the sintered alloy of sample No. 28 in which the P amount in the Fe—P alloy powder was small and the P amount in the overall composition was less than 0.2%, the amount of generated Fe—P—C eutectic liquid phase was small and the sintering was not promoted, whereby the density of the sintered body was extremely low. In contrast, in the sintered alloy of sample No. 29 in which P amount in the Fe—P alloy powder was increased and the P amount in the whole composition was 0.2%, the amount of generated Fe—P—C eutectic liquid phase was sufficient, whereby the density of the sintered body was increased to 6.85 $Mg/m^3$. When the P amount in the Fe—P alloy powder was further increased and the P amount in the overall composition was increased (samples Nos. 04 and 30 to 33), the amount of generated Fe—P—C eutectic liquid phase was increased according to increase of the P amount, whereby the density of the sintered showed a tendency to increase. In the sample No. 33 in which the P amount was more than 1%, the density of the sintered body was more than 7.4 $Mg/m^3$.

When the amount of generated Fe—P—C eutectic liquid phase was increased and sintering was promoted, growth of chromium carbides was promoted and the chromium carbides become coarse. Therefore, when the amount of Fe—P alloy powder was increased and the P amount in the overall composition was increased, the area ratio of carbides having the maximum diameter of 1 to 10 μm showed a tendency to decrease. Thus, in the sintered alloy of sample No. 33 in which the P amount in the overall composition was more than 1%, the area ratio of carbides having the maximum diameter of 1 to 10 μm was decreased to less than 90%.

The density of the sintered body increased according to increase of the P amount in the overall composition, whereby strength of the sintered alloy was increased. Therefore, in the sintered alloys of samples Nos. 04 and 28 to 30 in which the P amount in the overall composition was up to 0.6%, the wear amount showed a tendency to decrease according to increase of the P amount. In contrast, in the sintered alloys of samples Nos. 31 to 33 in which the P amount in the overall composition was more than 0.6%, disadvantageous effects of decrease of the number of pores and formation of coarse carbides were significant, rather than the effect of improving the strength of the sintered alloy as mentioned above, the wear amount showed a tendency to increase according to increase of the P amount. As a result, in the sintered alloy of sample 33 in which the P amount in the overall composition was more than 1%, the wear amount was large and was greater than 10 μm.

In the sintered alloys of samples Nos. 04 and 28 to 31 in which the P amount in the overall composition was up to 0.75%, the density of the sintered body was increased according to increase of the P amount, whereby the surface area was decreased and the oxidized amount showed a tendency to decrease. In contrast, in the sintered alloys of samples Nos. 32 and 33 in which the P amount in the overall composition was more than 0.75%, an Fe—P—C eutectic liquid phase was generated and leaked. As a result, the number of pores (Kirkendall voids) was increased and the oxidized amount showed a tendency to increase. Therefore, in the sintered alloy of sample 33 in which the amount of Fe—P alloy powder was excessive, the oxidized amount was extremely increased.

Thus, it was confirmed that when the P amount in the Fe—P alloy powder was 10 to 30%, the wear resistance and the corrosion resistance were improved.

Third Example

An iron alloy powder (Fe-20% Cr-8% Ni-0.8% Si) that was used for the sintered alloy sample No. 04 in the first example was added with 3% of an Fe—P alloy powder in which the P amount was 20%, and a graphite powder in which the amount is shown in Table 3, thereby mixing and obtaining a mixed powder. The mixed powder was compacted and the green compacts were sintered in the same conditions as in the first example, whereby sintered alloy samples Nos. 34 to 40 were formed. The overall compositions of the sintered alloy samples are shown together in Table 3. The sintered alloy samples were subjected to the same tests as in the first example. The results of the tests are shown in Table 3 together. The results in sample No. 04 in the first example are shown in Table 3 together.

TABLE 3

| Sample | Mixing ratio mass % | | | Whole composition mass % | | | | | | Density of | Area ratio of | Wear | Oxidized | |
|---|---|---|---|---|---|---|---|---|---|---|---|---|---|---|
| | Iron alloy | Fe—P alloy | Graphite | | | | | | | sintered body | 1~10 μm carbides | amount | amount | |
| No. | powder | powder | powder | Fe | Cr | Ni | Si | P | C | $Mg/m^3$ | % | μm | $g/m^2$ | Notes |
| 34 | Bal. | 3.00 | 0.30 | Bal. | 19.34 | 7.74 | 0.77 | 0.60 | 0.30 | 6.61 | 97 | 22.0 | 21 | Exceeds lower limit of C |

TABLE 3-continued

| Sample No. | Mixing ratio mass % Iron alloy powder | Fe—P alloy powder | Graphite powder | Whole composition mass % Fe | Cr | Ni | Si | P | C | Density of sintered body Mg/m³ | Area ratio of 1~10 μm carbides % | Wear amount μm | Oxidized amount g/m² | Notes |
|---|---|---|---|---|---|---|---|---|---|---|---|---|---|---|
| 35 | Bal. | 3.00 | 0.60 | Bal. | 19.28 | 7.71 | 0.77 | 0.60 | 0.60 | 6.80 | 97 | 5.0 | 9 | |
| 36 | Bal. | 3.00 | 1.00 | Bal. | 19.20 | 7.68 | 0.77 | 0.60 | 1.00 | 7.01 | 96 | 3.3 | 8 | |
| 04 | Bal. | 3.00 | 1.50 | Bal. | 19.10 | 7.64 | 0.76 | 0.60 | 1.50 | 7.20 | 95 | 2.4 | 8 | |
| 37 | Bal. | 3.00 | 2.00 | Bal. | 19.00 | 7.60 | 0.76 | 0.60 | 2.00 | 7.29 | 93 | 2.2 | 9 | |
| 38 | Bal. | 3.00 | 2.50 | Bal. | 18.90 | 7.56 | 0.76 | 0.60 | 2.50 | 7.38 | 92 | 2.7 | 11 | |
| 39 | Bal. | 3.00 | 3.00 | Bal. | 18.80 | 7.52 | 0.75 | 0.60 | 3.00 | 7.40 | 90 | 3.9 | 15 | |
| 40 | Bal. | 3.00 | 3.50 | Bal. | 18.70 | 7.48 | 0.75 | 0.60 | 3.50 | 7.40 | 85 | 10.6 | 26 | Exceeds upper limit of C |

Effects of Amount of C

Effects of the amount of C in the overall composition were evaluated based on the sintered alloys of samples Nos. 04, and 34 to 40 in Table 3.

In the sintered alloy of sample No. 34 in which the C amount was less than 0.6%, the amount of generated Fe—P—C eutectic liquid phase was small and the sintering was not promoted, whereby the density of the sintered body was low and less than 6.8 Mg/m³.

In contrast, in the sintered alloy of sample No. 35 in which the C amount was 0.6%, the amount of generated Fe—P—C eutectic liquid phase was sufficient and the sintering was promoted, whereby the density of the sintered body was increased to 6.80 Mg/m³. In the sintered alloys of samples No. 04 and 36 to 39 in which C amounts were 1.0 to 3.0, the amount of generated Fe—P—C eutectic liquid phase was increased according to increase of the C amount, whereby the density of the sintered body showed a tendency to increase.

It should be noted that in the sintered alloy of sample No. 40 in which C amount in the overall composition was more than 3%, since the amounts of the Fe—P alloy powder were even, the amount of generated Fe—P—C eutectic liquid phase was not greater than that of sample 39. Therefore, the density of the sintered alloy of sample No. 40 was the same as that of sample No. 39.

When the amount of generated Fe—P—C eutectic liquid phase was increased and sintering was promoted, growth of chromium carbides was promoted and the chromium carbides became coarse. Therefore, when the amount of the graphite powder was increased and the amount of C in the overall composition was increased, the area ratio of carbides having the maximum diameter of 1 to 10 μm showed a tendency to decrease. Thus, in the sintered alloy of sample No. 40 in which the C amount in the overall composition was more than 3%, the area ratio of carbides having the maximum diameter of 1 to 10 μm was reduced to less than 90%.

In the sintered alloy of sample 34 in which the C amount in the overall composition was less than 0.6%, since the density of the sintered body was low, the strength of the sintered body was low, whereby the wear amount was large. In contrast, in the sintered alloy of sample No. 35 in which the C amount in the overall composition was 0.6%, the density of the sintered body was improved to 6.8 Mg/m³ and had sufficient strength, whereby the wear amount was greatly decreased. In the sintered alloys of samples Nos. 04, 36 and 37 in which C amounts in the overall composition were 1.0 to 2.0%, since the density of the sintered body was increased according to increase of the C amount, the strength of the sintered body was improved, whereby the wear amount showed a tendency to decrease.

However, in the sintered alloys of samples Nos. 38 to 40 in which the C amounts in the overall composition were more than 2%, the area ratio of carbides having the maximum diameter of 1 to 10 μm was decreased according to increase of the C amount, whereby the wear amount showed a tendency to increase. As a result, in the sintered alloy of sample 40 in which the C amount in the overall composition was more than 3%, the wear amount was more than 10 μm.

In the sintered alloy of sample No. 34 in which the C amount in the overall composition was less than 0.6%, since the density of the sintered body was low, the oxidized amount was large. In contrast, in the sintered alloy of sample No. 35 in which the C amount in the overall composition was 0.6%, the density of the sintered body was improved to 6.8 Mg/m³, whereby the oxidized amount was extremely reduced. In the sintered alloys of samples Nos. 04 and 36 in which C amounts in the overall composition were 1.0 to 1.5%, since the density of the sintered body was increased according to increase of the C amount, the oxidized amount showed a tendency to decrease. However, in the sintered alloys of samples Nos. 37 to 40 in which C amounts in the overall composition were more than 1.5%, the amount of chromium carbides precipitated in the iron alloy matrix was increased according to increase of the C amount. As a result, the amount of Cr in the iron alloy matrix was decreased and the corrosion resistance thereof was reduced, whereby the oxidized amount showed a tendency to increase. Therefore, in the sintered alloy of sample No. 40 in which the C amount in the overall composition was more than 3%, the oxidized amount was extremely increased to more than 15 g/m².

Thus, it was confirmed that when the amount of C in the overall composition (the amount of the graphite powder) was 0.6 to 3%, the wear resistance and the corrosion resistance were improved.

Fourth Example

A mixed powder that was used for the sintered alloy sample No. 04 in the first example was used and sintered alloys of samples Nos. 41 to 52 were produced in conditions of compact densities and sintering temperatures shown in Table 4. Other production conditions were the same as those in the first example. The sintered alloy samples were subjected to the same tests as in the first example. The results of the tests are shown in Table 4 together. The results in sample No. 04 in the first example are shown in Table 4 together.

TABLE 4

| Sample No. | Density of compact $Mg/m^3$ | Sintering temperature ° C. | Desity of sintered body $Mg/m^3$ | Area ratio of 1~10 μm carbides % | Wear amount μm | Oxidized amount $g/m^2$ | Notes |
|---|---|---|---|---|---|---|---|
| 41 | 5.80 | 1130 | 6.60 | 95 | 10.7 | 22 | Exceeds lower limit of density |
| 42 | 6.00 | 1130 | 6.80 | 95 | 4.9 | 14 | |
| 43 | 6.17 | 1130 | 7.03 | 95 | 3.0 | 10 | |
| 04 | 6.40 | 1130 | 7.20 | 95 | 2.4 | 8 | |
| 44 | 6.60 | 1130 | 7.30 | 95 | 3.5 | 6 | |
| 45 | 6.80 | 1130 | 7.40 | 95 | 5.3 | 5 | |
| 46 | 7.00 | 1130 | 7.50 | 95 | 11.1 | 4 | Exceeds upper limit of density |
| 47 | 6.40 | 1080 | 6.40 | 98 | 10.8 | 24 | Exceeds lower limit of sintering temperature |
| 48 | 6.40 | 1100 | 6.81 | 98 | 5.0 | 12 | |
| 49 | 6.40 | 1120 | 7.09 | 97 | 3.0 | 9 | |
| 04 | 6.40 | 1130 | 7.20 | 95 | 2.4 | 8 | |
| 50 | 6.40 | 1140 | 7.31 | 94 | 3.0 | 6 | |
| 51 | 6.40 | 1160 | 7.40 | 92 | 4.0 | 5 | |
| 52 | 6.40 | 1180 | 7.50 | 87 | 12.0 | 3 | Exceeds upper limit of sintering temperature |

Effects of Density

Effects of the density of the compact and the density of the sintered body were evaluated based on the sintered alloy samples Nos. 04, and 41 to 46 in Table 4.

As shown by samples Nos. 04, and 41 to 46 in Table 4, the density of the sintered body increased when the density of the compact was increased. In the sintered alloy of sample 41 in which the density of the compact was less than 6.0 $Mg/m^3$, the density of the sintered body was less than 6.8 $Mg/m^3$. In the sintered alloy of sample 42 in which the density of the compact was 6.0 $Mg/m^3$, the density of the sintered body was 6.8 $Mg/m^3$. In the sintered alloy of sample 45 in which the density of the compact was 6.8 $Mg/m^3$, the density of the sintered body was 7.4 $Mg/m^3$. In the sintered alloy of sample 46 in which the density of the compact was more than 6.8 $Mg/m^3$, the density of the sintered body was 7.5 $Mg/m^3$.

The area ratio of carbides having the maximum diameter of 1 to 10 μm was even regardless of the density of the sintered body.

In the sintered alloy of sample No. 41 in which the density of the sintered body was less than 6.8 $Mg/m^3$, the wear amount was large since the strength of the sintered body was low. In contrast, in the sintered alloy of sample No. 42 in which the density of the sintered body was 6.8 $Mg/m^3$, the wear amount was decreased since the strength of the sintered body was sufficient. In the sintered alloys from sample No. 41 to sample No. 04 in which the density of the sintered body was 7.2 $Mg/m^3$, the wear amount showed a tendency to decrease according to increase of strength of the sintered body. However, when the density of the sintered body was greater than 7.2 $Mg/m^3$, the amount of chromium passivation film decreased due to decrease in the number of pores, whereby the wear amount showed a tendency to increase. As a result, in the sintered alloy of sample No. 46 in which the density of the sintered body was greater than 7.4 $Mg/m^3$, the wear amount was greater than 10 μm.

The oxidized amount showed a tendency to increase according to increase in the density of the sintered body. In the sintered alloy of sample 41 in which the density of the sintered body was less than 6.8 $Mg/m^3$, the number of pores was large, whereby the oxidized amount was large. In contrast, in the sintered alloy of sample 42 in which the density of the sintered body was 6.8 $Mg/m^3$, the oxidized amount was decreased to 14 $g/m^2$.

Thus, it was confirmed that when the density of the sintered body was 6.8 to 7.4 $Mg/m^3$, the wear resistance and the corrosion resistance were good. Also, it was confirmed that when the compact density was 6.0 to 6.8 $Mg/m^3$, the density of the sintered body was 6.8 to 7.4 $Mg/m^3$.

Effects of Sintering Temperature

Effects of the sintering temperature are evaluated based on the sintered alloys of samples Nos. 04, and 47 to 52 in Table 4.

As shown by samples Nos. 04, and 47 to 52 in Table 4, the density of the sintered body increased when the sintering temperature was high and the sintering was promoted. In the sintered alloy of sample No. 47 in which the sintering temperature was less than 1100° C., an Fe—P—C eutectic liquid phase was not sufficiently generated in sintering, whereby the density of the sintered alloy was less than 6.8 $Mg/m^3$. In the sintered alloy of sample No. 48 in which the sintering temperature was 1100° C., the density of the sintered alloy was 6.8 $Mg/m^3$. In contrast, in the sintered alloy of sample No. 51 in which the sintering temperature was 1160° C., the density of the sintered alloy was 7.4 $Mg/m^3$, and in the sintered alloy of sample No. 52 in which the sintering temperature was greater than 1160° C., the sintering was excessively promoted and the density of the sintered alloy was greater than 7.4 $Mg/m^3$.

When the sintering temperature was high, chromium carbides precipitated in the iron alloy matrix readily grew. Therefore, the area ratio of carbides having the maximum diameter of 1 to 10 μm showed a tendency to decrease as the sintering temperature increased. Thus, in the sintered alloy of sample No. 52 in which the sintering temperature was greater than 1160° C., the area ratio of carbides having the maximum diameter of 1 to 10 μm was less than 90%.

In the sintered alloy of sample No. 47 in which the sintering temperature was less than 1100° C., the density of the sintered body was less than 6.8 $Mg/m^3$. Since the strength of the sintered body was low, the wear amount was greater than 10 μm. In contrast, in the sintered alloy of sample No. 48 in which the sintering temperature was 1100° C., the strength of the sintered body was sufficient and the wear amount decreased. In the sintered alloy of sample No. 04 in which the sintering temperature was 1130° C., the wear amount showed a tendency to decrease due to increase in strength of the sintered body. However, when the sintering temperature was greater than 1130° C., the amount of chromium passivation film was reduced due to decrease in the number of pores, whereby the wear amount showed an increase. In the sintered alloy of sample No. 52 in which the sintering temperature was greater than 1160° C., the wear amount was greater than 10 μm.

The oxidized amount showed a tendency to decrease as the sintering temperature was increased. In the sintered alloy of sample 47 in which the sintering temperature was less than 1100° C., the number of pores was large since the sintering temperature was low, whereby the oxidized amount was large. In contrast, in the sintered alloy of sample No. 48 in which the sintering temperature was 1100° C., the number of pores was decreased, whereby the oxidized amount was decreased to 12 g/m$^2$.

Thus, it was confirmed that when sintering temperature was 1100 to 1160° C., the density of the sintered body was 6.8 to 7.4 Mg/m$^3$, and the wear resistance and the corrosion resistance of the sintered alloy were good.

Fifth Example

An alloy powder of which the composition is shown in Table 5 was prepared as an iron alloy powder, the alloy powder was mixed with 3% of an Fe—P alloy powder in which the P amount was 20%, and 1.5% of a graphite powder, thereby mixing and obtaining a mixed powder. Then, sintered alloys of samples Nos. 53 to 59 were produced in the same condition as in the first example. The entire compositions of the sintered alloys of samples are shown together in Table 5. The sintered alloys of samples were subjected to the same tests as in the first example. The results of the tests are shown in Table 5 together. The results in sample No. 04 in the first example are shown in Table 5 together.

higher specific gravity than Fe, was increased, and the density ratio was approximately constant (94%).

The area ratio of carbides having the maximum diameter of 1 to 10 pin of the sintered alloys of Nos. 53 to 59 that contained Mo was approximately the same as that of the sintered alloy of sample No. 04 that did not contain Mo.

Since Mo precipitated as carbides and improved wear resistance of the sintered alloy, the wear amount showed a tendency to decrease as the Mo amount was increased. However, when the Mo amount was greater than 3%, further effects of decrease of the wear amount were not exhibited.

Mo is superior in carbide formation capacity compared to Cr, thereby preferentially forming carbides, whereby Cr, which improves corrosion resistance, was inhibited to precipitate as carbides form the iron alloy matrix. Therefore, the oxidized amount showed a tendency to slightly decrease as the Mo amount was increased. However, when the Mo amount was greater than 3%, further effects of decrease of the wear amount were not exhibited.

Thus, it was confirmed that when Mo was contained as an alloying element in the iron alloy powder, the wear amount and the corrosion resistance were further improved. It was confirmed that even though Mo was contained at more than 3%, further improvement of the wear resistance and the corrosion resistance were not exhibited, whereby the Mo amount is preferably 3% or less.

The sintered alloy of the present invention has superior heat resistance, corrosion resistance, and wear resistance, and it

TABLE 5

| Sample No. | Mixing ratio mass % | | | | | | | | Whole composition mass % | | | | | | |
|---|---|---|---|---|---|---|---|---|---|---|---|---|---|---|---|
| | Iron alloy powder | | | | | | Fe—P alloy powder | Graphite powder | | | | | | | |
| | | Composition mass % | | | | | | | | | | | | | |
| | | Fe | Cr | Ni | Si | Mo | | | Fe | Cr | Ni | Si | P | C | Mo |
| 04 | Bal. | Bal. | 20.00 | 8.00 | 0.80 | 0.00 | 3.00 | 1.50 | Bal. | 19.10 | 7.64 | 0.76 | 0.60 | 1.50 | 0.00 |
| 53 | Bal. | Bal. | 20.00 | 8.00 | 0.80 | 0.50 | 3.00 | 1.50 | Bal. | 19.10 | 7.64 | 0.76 | 0.60 | 1.50 | 0.48 |
| 54 | Bal. | Bal. | 20.00 | 8.00 | 0.80 | 1.00 | 3.00 | 1.50 | Bal. | 19.10 | 7.64 | 0.76 | 0.60 | 1.50 | 0.96 |
| 55 | Bal. | Bal. | 20.00 | 8.00 | 0.80 | 1.50 | 3.00 | 1.50 | Bal. | 19.10 | 7.64 | 0.76 | 0.60 | 1.50 | 1.43 |
| 56 | Bal. | Bal. | 20.00 | 8.00 | 0.80 | 2.00 | 3.00 | 1.50 | Bal. | 19.10 | 7.64 | 0.76 | 0.60 | 1.50 | 1.91 |
| 57 | Bal. | Bal. | 20.00 | 8.00 | 0.80 | 2.50 | 3.00 | 1.50 | Bal. | 19.10 | 7.64 | 0.76 | 0.60 | 1.50 | 2.39 |
| 58 | Bal. | Bal. | 20.00 | 8.00 | 0.80 | 3.00 | 3.00 | 1.50 | Bal. | 19.10 | 7.64 | 0.76 | 0.60 | 1.50 | 2.87 |
| 59 | Bal. | Bal. | 20.00 | 8.00 | 0.80 | 3.50 | 3.00 | 1.50 | Bal. | 19.10 | 7.64 | 0.76 | 0.60 | 1.50 | 3.34 |

| Sample No. | Density of sintered body Mg/m$^3$ | Area ratio of 1~10 μm carbides % | Wear amount μm | Oxidized amount g/m | Notes |
|---|---|---|---|---|---|
| 04 | 7.20 | 95 | 2.4 | 8 | |
| 53 | 7.21 | 94 | 2.3 | 7 | |
| 54 | 7.22 | 94 | 2.2 | 7 | |
| 55 | 7.23 | 93 | 2.2 | 6 | |
| 56 | 7.24 | 93 | 2.1 | 6 | |
| 57 | 7.28 | 93 | 2.0 | 5 | |
| 58 | 7.30 | 92 | 2.0 | 5 | |
| 59 | 7.31 | 93 | 2.0 | 5 | Exceeds upper limit of Mo |

Effects of Optional Elements

Effects of the optional elements are evaluated based on the sintered alloys of samples Nos. 04, and 53 to 59 in Table 5. In the example, Mo was used as an optional element. In the sintered alloys of samples Nos. 53 to 59 in which Mo was contained, the density of the sintered body was increased compared to the sintered alloy in which Mo was not contained, and the density of the sintered body showed a tendency to increase as the amount of Mo was increased. The reason for this tendency is that the amount of Mo, having a may be used in turbo components of turbochargers, and specifically, nozzle bodies that must have heat resistance, corrosion resistance, and wear resistance.

What is claimed is:

1. A sintered alloy comprising:

an overall composition consisting of, by mass %, 13.05 to 29.62% of Cr, 6.09 to 23.70% of Ni, 0.44 to 2.96% of Si, 0.2 to 1.0% of P, 0.6 to 3.0% of C, and the balance of Fe and inevitable impurities;

an austenitic structure in which carbides are precipitated and uniformly dispersed in an iron alloy matrix having dispersed pores; and a density of 6.8 to 7.4 $Mg/m^3$, wherein the carbides include carbides having a maximum diameter of 1 to 10 μm, which have an area ratio of 90% or more with respect to that of the total carbides.

2. The sintered alloy according to claim 1, wherein nitrides are formed on a surface of the sintered alloy and inner surfaces of the pores.

3. A production method for sintered alloy, the method comprising:

preparing an Fe alloy powder, an Fe—P alloy powder, and a graphite powder, the Fe alloy powder consisting of, by mass %, 15 to 30% of Cr, 7 to 24% of Ni, 0.5 to 3.0% of Si, optionally 3.0% or less of at least one of Mo, V, W, Nb, and Ti, and the balance of Fe and inevitable impurities, the Fe—P alloy powder consisting of 10 to 30 mass % of P and the balance of Fe and inevitable impurities;

mixing the Fe—P powder and 0.6 to 3.0 mass % of the graphite powder with the Fe alloy powder into a mixed powder, such that the amount of P is 0.2 to 1.0 mass % with respect to the overall composition of the mixed powder;

compacting the mixed powder into a green compact having a density of 6.0 to 6.8 $Mg/m^3$, and sintering the green compact at a temperature of 1100 to 1160° C. in a non-oxidizing gas at normal pressure.

4. The production method for sintered alloy according to claim 3, wherein the non-oxidizing gas is nitrogen gas or a mixed gas of nitrogen and hydrogen that contains at least 10 volume % nitrogen.

5. A sintered alloy produced by the production method recited in claim 3 comprising:

an overall composition consisting of, by mass %, 13.05 to 29.62% of Cr, 6.09 to 23.70% of Ni, 0.44 to 2.96% of Si, 0.2 to 1.0% of P, 0.6 to 3.0% of C, 2.96% or less of at least one of Mo, V, W, Nb, and Ti, and the balance of Fe and inevitable impurities;

an austenitic structure in which carbides are precipitated and uniformly dispersed in an iron alloy matrix having dispersed pores; and a density of 6.8 to 7.4 $Mg/m^3$, wherein the carbides include carbides having maximum diameter of 1 to 10 μm, which have an area ratio of 90% or more with respect to that of the total carbides.

6. The sintered alloy according to claim 5, wherein nitrides are formed on a surface of the sintered alloy and inner surfaces of the pores.

* * * * *